US011522312B2

(12) United States Patent
Holtz et al.

(10) Patent No.: US 11,522,312 B2
(45) Date of Patent: Dec. 6, 2022

(54) SAFETY ADAPTER FOR ELECTRICAL CONNECTORS

(71) Applicant: Keithley Instruments, LLC, Solon, OH (US)

(72) Inventors: Matthew Alan Holtz, Solon, OH (US); Joseph A. Peters, Cuyahoga Falls, OH (US); Vladimir V. Genkin, Westfield, OH (US)

(73) Assignee: Keithley Instruments, LLC, Solon, OH (US)

( * ) Notice: Subject to any disclaimer, the term of this patent is extended or adjusted under 35 U.S.C. 154(b) by 0 days.

(21) Appl. No.: 17/111,384

(22) Filed: Dec. 3, 2020

(65) Prior Publication Data

US 2021/0175657 A1 Jun. 10, 2021

Related U.S. Application Data

(60) Provisional application No. 62/945,018, filed on Dec. 6, 2019.

(51) Int. Cl.

| | |
|---|---|
| ***H01R 13/453*** | (2006.01) |
| ***H01R 13/11*** | (2006.01) |
| ***H01R 24/54*** | (2011.01) |
| ***H01R 13/44*** | (2006.01) |
| ***H01R 43/26*** | (2006.01) |

(52) U.S. Cl.

CPC ..... *H01R 13/4538* (2013.01); *H01R 13/111* (2013.01); *H01R 13/44* (2013.01); *H01R 24/542* (2013.01); *H01R 43/26* (2013.01)

(58) Field of Classification Search

None

See application file for complete search history.

(56) References Cited

U.S. PATENT DOCUMENTS

| | | | | |
|---|---|---|---|---|
| 7,070,448 | B2 * | 7/2006 | Khemakhem | H01R 24/542 439/322 |
| 7,778,037 | B2 * | 8/2010 | Huang | G06K 19/07732 361/752 |
| 7,787,243 | B2 * | 8/2010 | Salazar | H05K 5/0278 361/679.31 |

* cited by examiner

*Primary Examiner* — Ross N Gushi

(74) *Attorney, Agent, or Firm* — Miller Nash LLP; Andrew J. Harrington

(57) ABSTRACT

A safety adapter assembly includes a first electrical connector, a second electrical connector, a connector body, and a safety sleeve. The connector body is structured to couple the first electrical connector to the second electrical connector. The safety sleeve is substantially surrounding the connector body and configured to move relative to the connector body to selectively allow user access to the first electrical connector while substantially blocking user access to the second electrical connector, or to allow user access to the second electrical connector while substantially blocking user access to the first electrical connector.

8 Claims, 5 Drawing Sheets

SAFETY ADAPTER FOR ELECTRICAL CONNECTORS

CROSS-REFERENCES TO RELATED APPLICATIONS

This patent application claims the benefit of provisional Application No. 62/945,018 filed Dec. 6, 2019, which is incorporated into the present disclosure by this reference.

TECHNICAL FIELD

This disclosure relates to test and measurement systems, and more particularly to connection interfaces in a test and measurement system.

BACKGROUND

Recently, applicable safety agencies have increased safety spacing requirements for electrical components. While existing equipment is generally unaffected by these new requirements, new designs for test and measurement instrumentation must meet the new requirements. One component affected by the new safety requirements are triaxial connectors. Triaxial connectors are often used in source measure units (SMUs), semiconductor test systems, as well as other test and measurement instruments.

Therefore, newly-designed high-voltage equipment using triaxial connectors must use different connectors than what had previously been the industry standard. Of course, there is a large installed base of equipment that use the previous industry-standard triaxial connectors, and those instruments are often integrated into test systems with other test fixtures and cables. Some systems, for example, may include up to 128 triaxial cables. The new-style female connectors, though, will deliberately not mate directly with the old-style male connectors because that would defeat the new safety spacing requirements.

It is important to understand the difference between functional voltage spacing requirements and safety voltage spacing requirements. While the former is determined by physics and material properties, and is aimed to prevent the dielectric breakdown within connectors, the latter is a subject for interpretation and agency regulations. Therefore, today's safe connector can become unsafe tomorrow with no physical changes, when a safety agency changes its standards.

Embodiments of the disclosed technology address shortcomings in the prior art.

DETAILED DESCRIPTION

As described herein, embodiments are directed to novel means of allowing existing cables with low-voltage triaxial connectors to safely connect to the new high-voltage triaxial connectors (up to 1100V) found on new product designs. More generally, embodiments provide a safety adapter between connections having different connector types by allowing user access to one connector at a time. Embodiments of the disclosure do not rely on a special mating interface, but instead constrain the interconnect sequence to assure safety.

Figure 1:
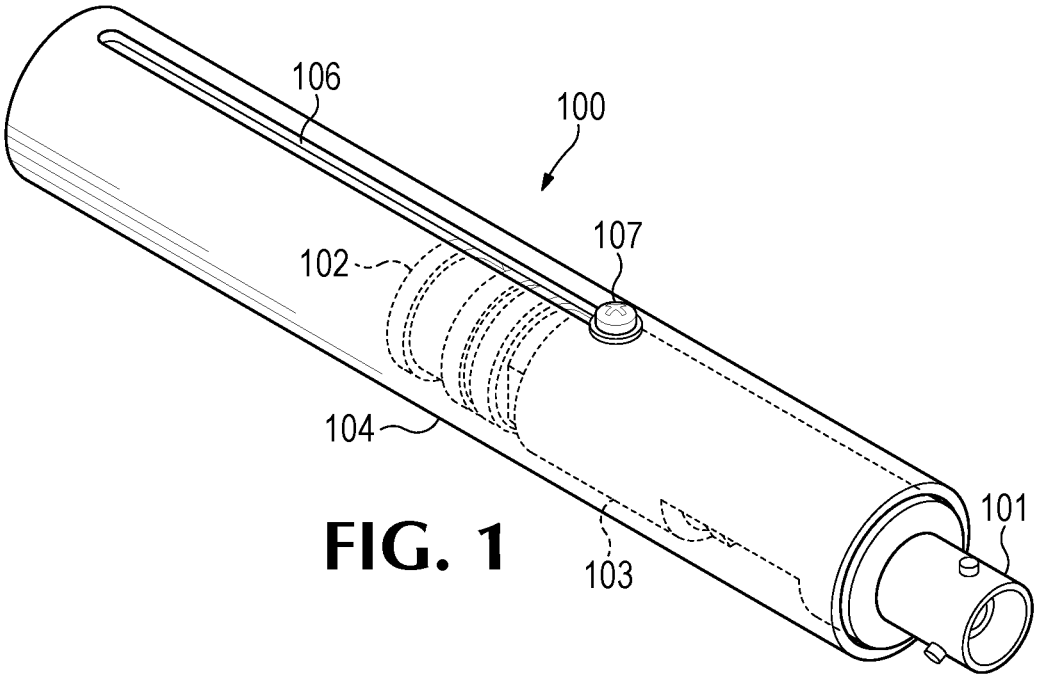
FIG. 1 is a perspective view of a safety adapter assembly, according to embodiments, illustrating a configuration where a first electrical connector of the safety adapter assembly is exposed and a second electrical connector of the safety adapter assembly is concealed within an example safety sleeve of the safety adapter assembly.
Figure 2:
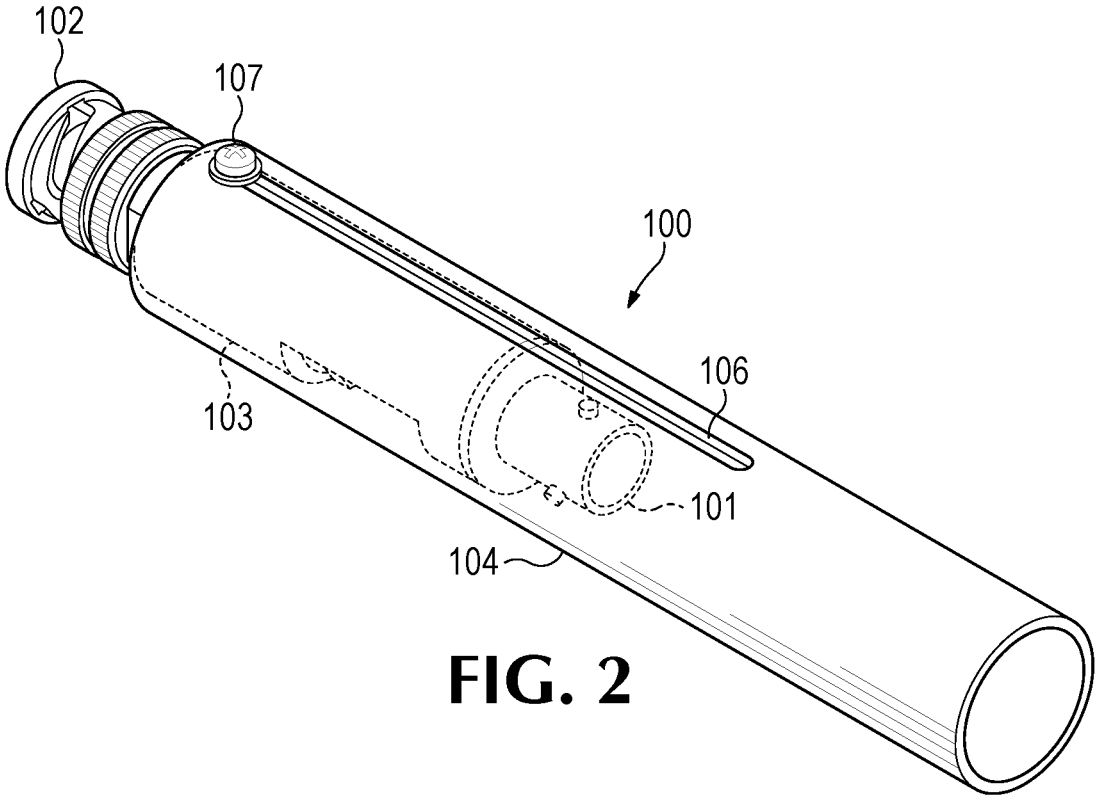
FIG. 2 is a perspective view of the safety adapter assembly of FIG. 1, illustrating a configuration where the second electrical connector of the safety adapter assembly is exposed and the first electrical connector of the safety adapter assembly is concealed within the safety sleeve.
Figure 3:
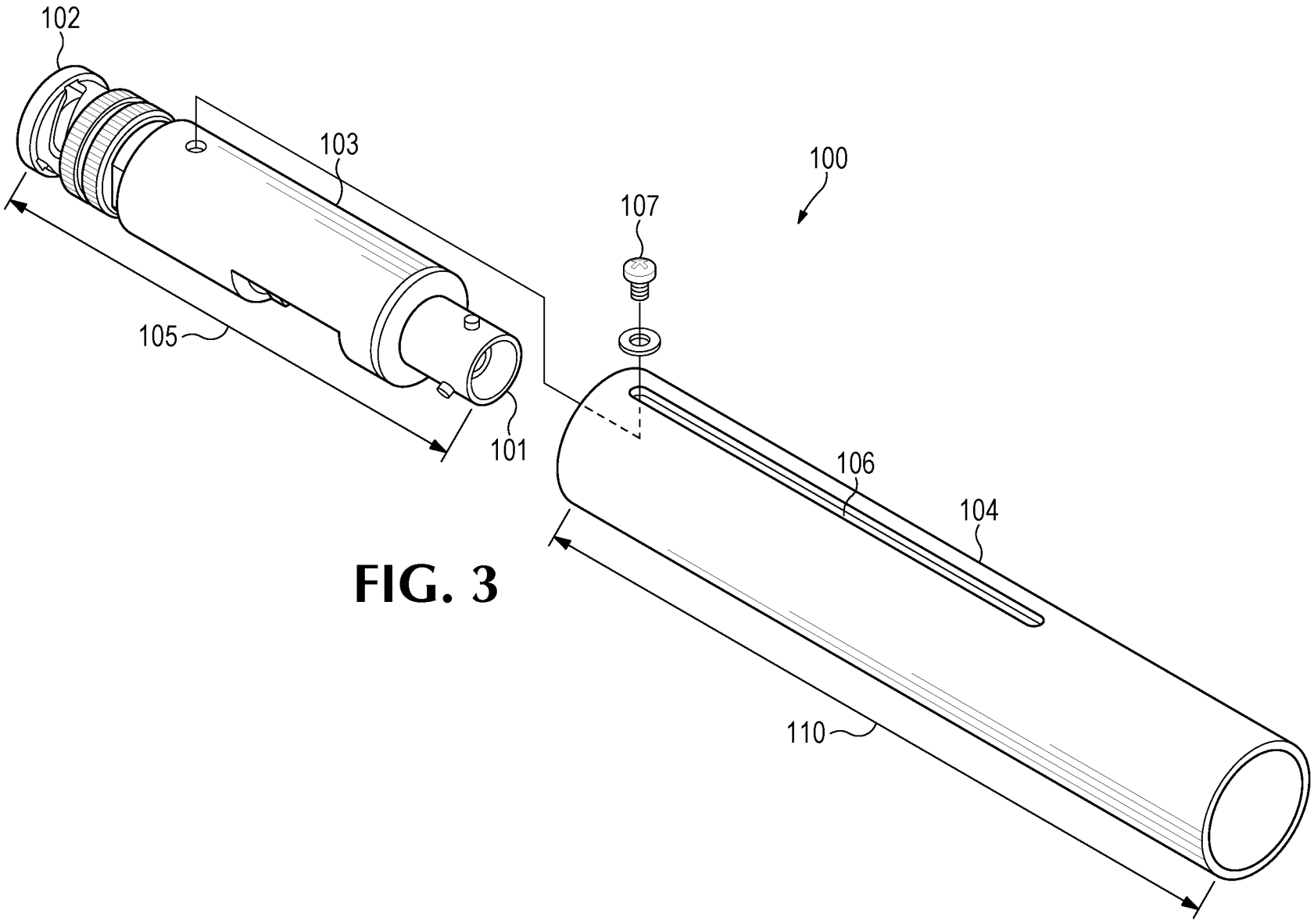
FIG. 3 is an exploded view of a safety adapter assembly of FIGS. 1-2.

FIG. 1 is a perspective view showing portions of a safety adapter assembly, according to embodiments. The safety adapter assembly is illustrated in a configuration where a first electrical connector of the safety adapter assembly is exposed and a second electrical connector of the safety adapter assembly is concealed within an example safety sleeve of the safety adapter assembly. FIG. 2 is a perspective view of the safety adapter assembly of FIG. 1, illustrating a configuration where the second electrical connector of the safety adapter assembly is exposed and the first electrical connector of the safety adapter assembly is concealed within the safety sleeve. FIG. 3 is exploded view of the safety adapter assembly of FIGS. 1-2.

As illustrated in FIGS. 1-3, a safety adapter assembly 100 may include a first electrical connector 10, second electrical connector 102, a connector body 103, and a safety sleeve 104.

The connector body 103 is configured to structurally and electrically couple the first electrical connector 101 to the second electrical connector 102. As illustrated in FIG. 3, the first electrical connector 10, the connector body 103, and the second electrical connector 102 all together have an overall connector length 105.

Each of the first electrical connector 101 and the second electrical connector 102 may be triaxial connectors, although other connector types could be used in embodiments.

The first electrical connector 101 may include a first connector type, and the second electrical connector 102 may include a second connector type that is not physically compatible with the first connector type. As used in this disclosure, "not physically compatible" means that a male connector of the first connector type could not be directly mated to a female connector of the second connector type in normal use. Likewise, a female connector of the first connector type could not be directly mated to a male connector of the second connector type in normal use. For example, the first electrical connector 101 and the second electrical connector 102 might comply with different industry standards for connectors. As another example, the first electrical connector 101 may comply with the international standard IEC 61010, 2nd Edition, while the second electrical connector 102 may comply with the standard IEC 61010, 3rd Edition. These IEC standards are published by the International Electrotechnical Commission.

The safety sleeve 104 is preferably electrically nonconductive and configured to substantially surround the connector body 103. As used in this disclosure, "substantially surround" means largely or essentially extending around without requiring perfect encircling. The safety sleeve 104 is further configured to slidingly engage the connector body 103 to selectively allow user access to the first electrical connector 101 while substantially blocking user access to the second electrical connector 102. An example of such a configuration is illustrated in FIG. 1. As used in this disclosure, "substantially blocking" means largely or essentially obstructing without requiring a perfect barricade to all access. The safety sleeve 104 is also configured to selectively allow user access to the second electrical connector 102 while substantially blocking user access to the first electrical connector 10. An example of such a configuration is illustrated in FIG. 2.

In embodiments, the safety sleeve 104 may include a longitudinal slot 106, and the safety adapter assembly 100 may include a pin 107 configured to extend away from the connector body 103 and through the slot 106 of the safety sleeve 104. The pin 107 may be, for example, a screw. The slot 106 and the pin 107 together are configured to constrain sliding movement of the safety sleeve 104 relative to the connector body 103. For example, slot 106 and the pin 107 together may limit travel of the safety sleeve 104 in a first direction 108 or in a second direction 109, or both. The first direction 108 and the second direction 109 are described more fully below in the discussion for FIG. 4. In embodiments, the pin 107 is configured to permanently join the sleeve to the connector body 103. As used in this context, "permanently join" means that the safety sleeve 104 and the pin 107 cannot be separated or moved away from each other without causing permanent damage to either component.

As illustrated in FIG. 3, the safety sleeve 104 has an overall sleeve length 1. In embodiments, the overall sleeve length 110 is not less than the overall connector length 105. In embodiments, the safety sleeve 104 is substantially cylindrical. As used in this disclosure, "substantially cylindrical" means largely or essentially cylindrical without requiring perfect cylindricality.

Figure 4:
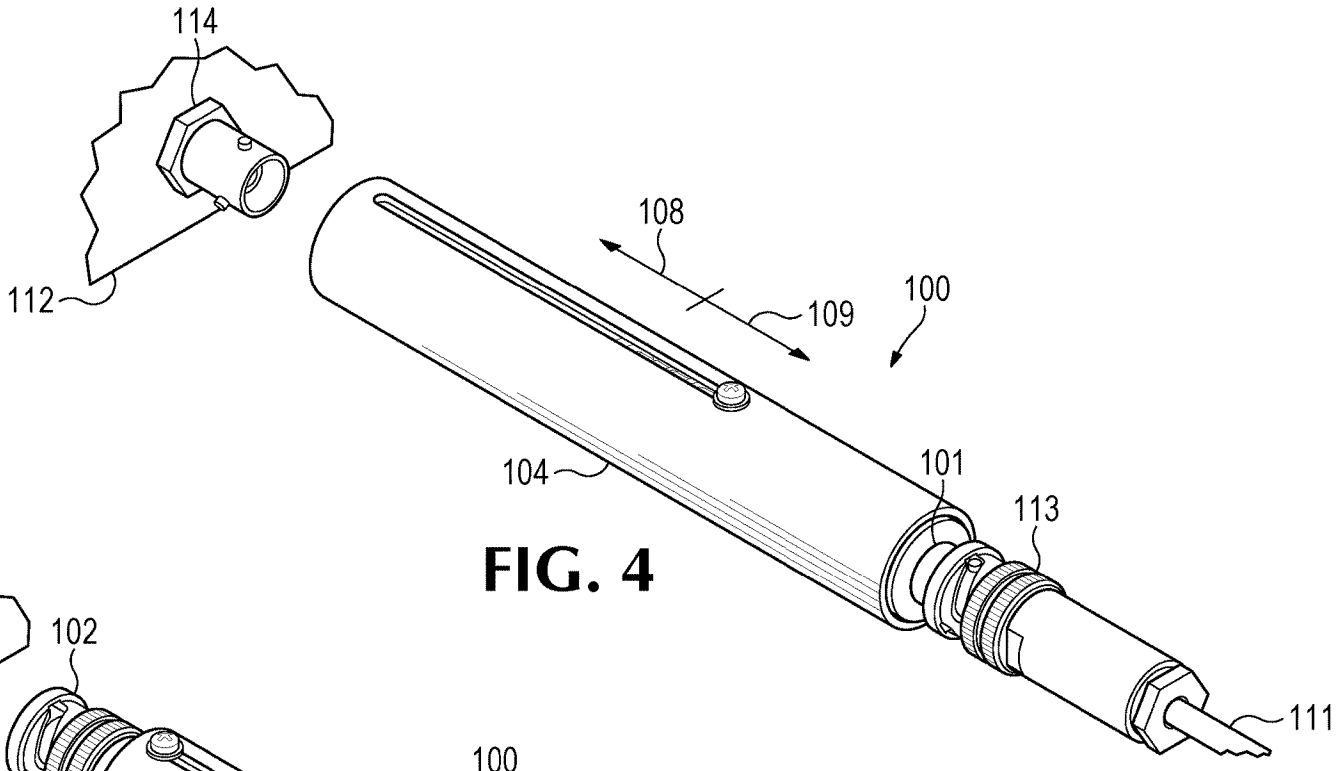
FIG. 4 is a perspective view illustrating the safety adapter assembly of FIGS. 1-3 connected to an example test-and-measurement cable at the first electrical connector, with the second electrical connector of the safety adapter assembly concealed within the safety sleeve.
Figure 5:
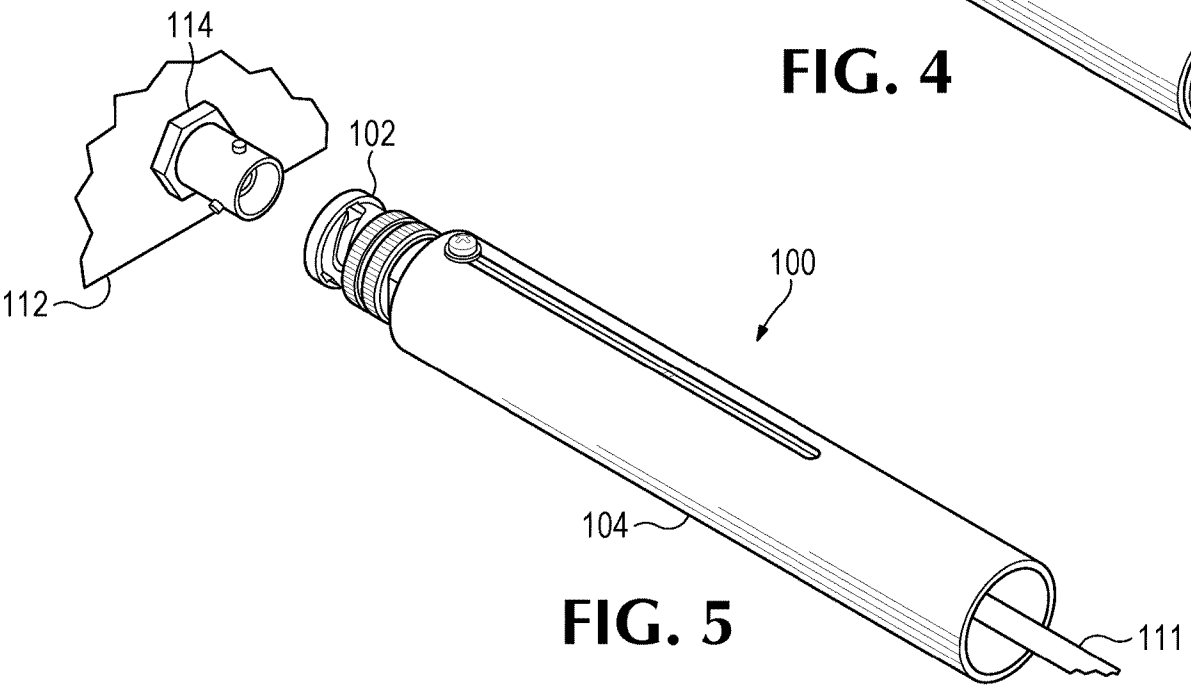
FIG. 5 is a perspective view illustrating the safety adapter assembly of FIG. 4, with the first electrical connector concealed within the example safety sleeve and the second electrical connector exposed for connection to an example test-and-measurement device.
Figure 6:
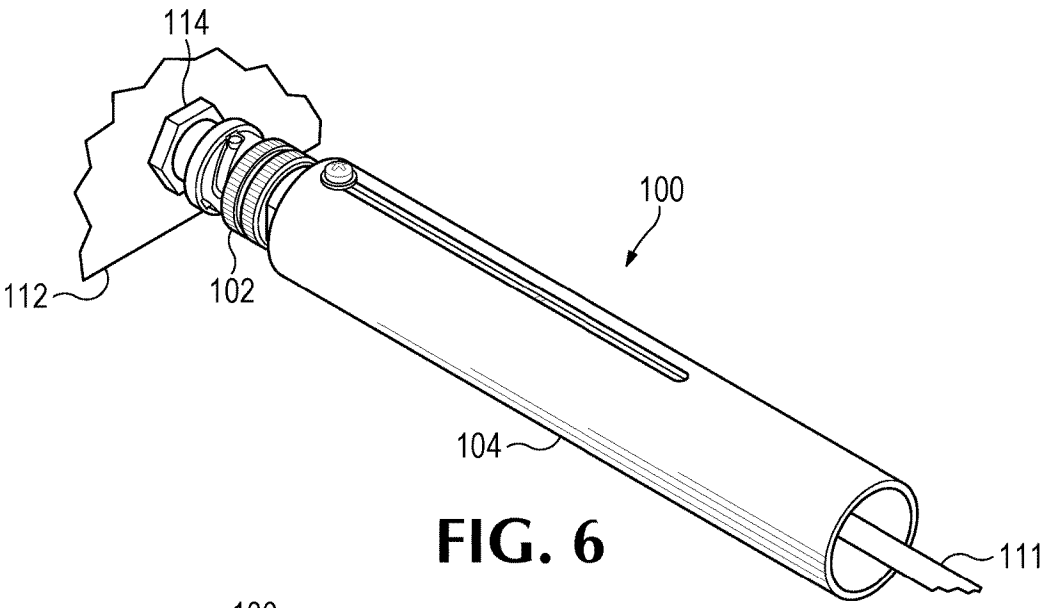
FIG. 6 is a perspective view illustrating the safety adapter assembly of FIG. 5, with the second electrical connector connected to the example test-and-measurement device.

As illustrated in FIGS. 4-6, the safety adapter assembly 100 may be configured to serve as an adapter between a test-and-measurement cable 111 and a test-and-measurement device 112. Hence, for example, the first electrical connector 101 may be configured to connect the safety adapter assembly 100 to the test-and-measurement cable 111, and the second electrical connector 102 may be configured to connect the safety adapter assembly 100 to the test-and-measurement device 112, particularly where the test-and-measurement cable 111 has a first connector type and the test-and-measurement device 112 has a second connector type that is not physically compatible with the first connector type.

Starting with FIG. 4, FIG. 4 is a perspective view illustrating the safety adapter assembly 100 of FIGS. 1-3 connected to the test-and-measurement cable in at the first electrical connector 101 of the safety adapter assembly 100, with the second electrical connector 102 of the safety adapter assembly 100 concealed within the safety sleeve 104 of the safety adapter assembly 100.

Before connecting the safety adapter assembly 100 to the connector 113 of the test-and-measurement cable 111, the user may slide the safety sleeve 104 relative to the connector body 103 (see FIG. 3) in the first direction 108 to expose the first electrical connector 101 and to conceal the second electrical connector 102 of the safety adapter assembly 100 within the safety sleeve 104. In this configuration (another example of which is illustrated in FIG. 1), the safety sleeve 104 substantially blocks user access to the second electrical connector 102, thus providing a safety feature.

The user may then attach the first electrical connector 101 to a first connector external to the safety adapter assembly 100, which, in the example illustrated in FIG. 4, is the connector 113 of the test-and-measurement cable 111.

Then, the user may slide the safety sleeve 104 relative to the connector body 103 in the second direction 109 to expose the second electrical connector 102 and to conceal the first electrical connector 101 within the safety sleeve 104.

Hence, FIG. 5 is a perspective view illustrating the safety adapter assembly 100 of FIG. 4, with the first electrical connector 101 concealed within the example safety sleeve 104 and the second electrical connector 102 exposed for connection to the test-and-measurement device 112. In this configuration (another example of which is illustrated in FIG. 2), the safety sleeve 104 substantially blocks user access to the first electrical connector 101, thus providing a safety feature.

Then, the user may attach the second electrical connector 102 to a second connector external to the safety adapter assembly 100, which, in the example illustrated in FIG. 5, is the connector 114 of the test-and-measurement device 112.

Hence, FIG. 6 is a perspective view illustrating the safety adapter assembly 100 of FIG. 5, with the second electrical connector 102 connected to the example test-and-measurement device 112.

Figure 7:
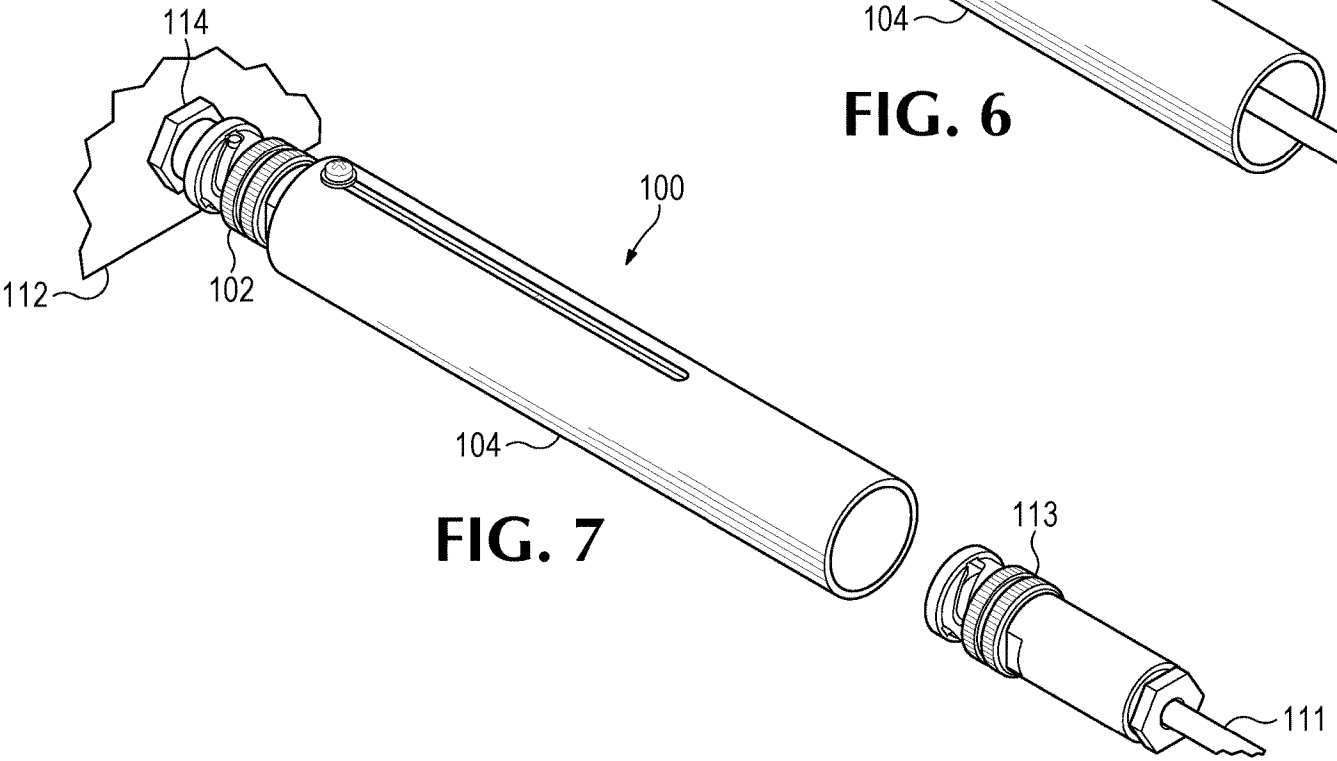
FIG. 7 is a perspective view of the safety adapter assembly of FIGS. 1-3, illustrating that, in embodiments, if the second electrical connector is connected to the example test-and-measurement device before the first electrical connector is connected to the example test-and-measurement cable, the user will not be able to access the first electrical connector to make the connection.

FIG. 7 is a perspective view of the safety adapter assembly 100 of FIGS. 1-3, illustrating that, in embodiments, if the second electrical connector 102 is connected to the example test-and-measurement device 112 before the first electrical connector 101 is connected to the example test-and-measurement cable 111, the user will not be able to access the first electrical connector 101 to make the connection. Hence, as illustrated in FIG. 7, the user has connected the second electrical connector 102 to the test-and-measurement device 112 without having first connected the first electrical connector 101 to the test-and-measurement cable 111.

As illustrated in FIG. 7, though, the user may not connect the first electrical connector 101 to the test-and-measurement cable 111 after the user has connected the second electrical connector 102 to the test-and-measurement device 112. This is because the safety sleeve 104 continues to substantially block user access to the first electrical connector 101. Moreover, in some embodiments and implementations, the user cannot slide the safety sleeve 104 to expose the first electrical connector 101 because the sliding motion of the safety sleeve 104 would be limited by contact between the safety sleeve 104 and the test-and-measurement device 112, such as a panel of test-and-measurement device 112.

Accordingly, the safety adapter assembly 100 may ensure that the connections from the safety adapter assembly 100 to external connectors are made in the proper, safest sequence.

Figure 8:
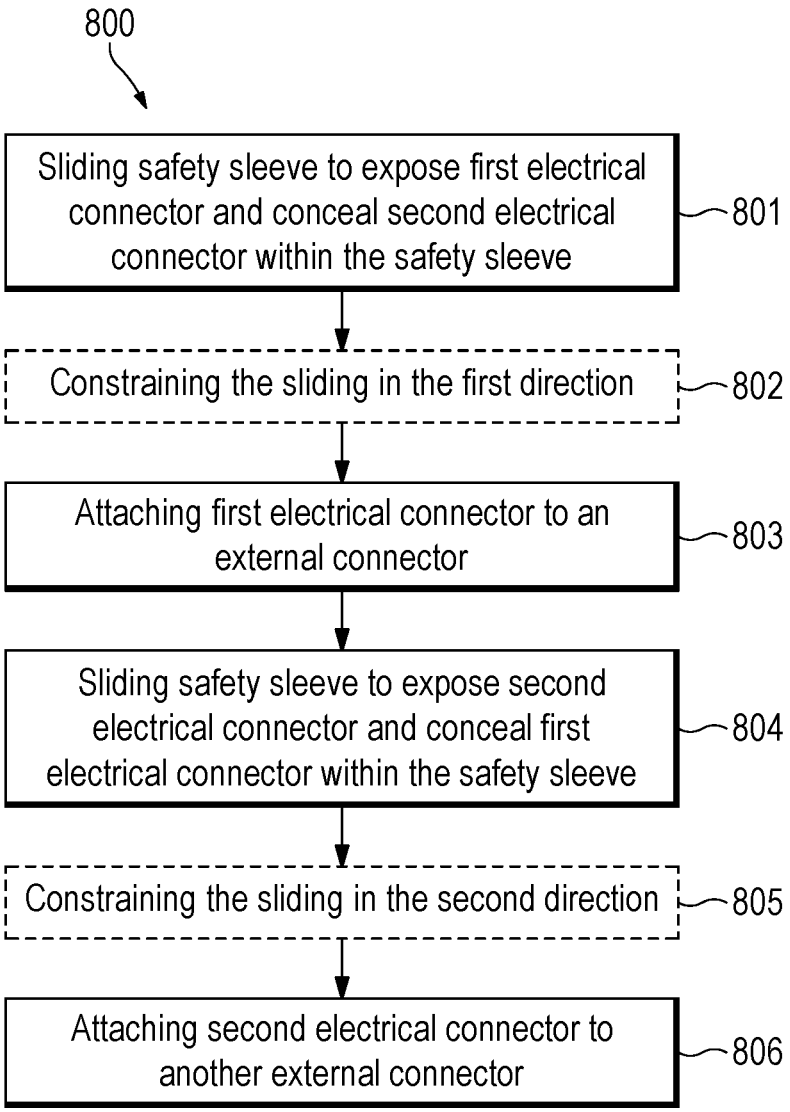
FIG. 8 is a flowchart illustrating an example method of using a safety adapter assembly for an electrical connector.

FIG. 8 is a flowchart illustrating an example method of using a safety adapter assembly for an electrical connector. As illustrated in FIG. 8, the method 800 may include sliding 801 an electrically nonconductive safety sleeve relative to a connector body of the safety adapter assembly to expose a first electrical connector of the safety adapter assembly and to conceal a second electrical connector of the safety adapter assembly within the safety sleeve; attaching 803 the first electrical connector to a first connector external to the safety adapter assembly; sliding 804 the safety sleeve relative to the connector body of the safety adapter assembly to expose the second electrical connector of the safety adapter assembly and to conceal the first electrical connector of the safety adapter assembly within the safety sleeve; and attaching 806 the second electrical connector to a second connector external to the safety adapter assembly.

The method 800 may further include constraining 802 the sliding in the first direction, for example, by using a pin coupled to the connector body and configured to extend away from the connector body and through a longitudinal slot of the safety sleeve.

The method 800 may further include constraining 803 the sliding in the second direction, for example, by using a pin coupled to the connector body and configured to extend away from the connector body and through a longitudinal slot of the safety sleeve.

The method 800 may further include permanently joining the safety sleeve to the connector body with the pin.

EXAMPLES

Illustrative examples of the disclosed technologies are provided below. An embodiment of the technologies may include one or more, and any combination of, the examples described below.

Example 1 includes a safety adapter assembly comprising: a first electrical connector; a second electrical connector; a connector body structured to couple the first electrical connector to the second electrical connector; and a safety sleeve substantially surrounding the connector body and configured to move relative to the connector body to selectively allow user access to the first electrical connector while substantially blocking user access to the second electrical connector, or to allow user access to the second electrical connector while substantially blocking user access to the first electrical connector.

Example 2 includes the safety adapter assembly of Example 1, in which the safety sleeve is configured to slide relative to the connector body.

Example 3 includes the safety adapter assembly of Example 2, the safety sleeve further comprising a slot, and the safety adapter assembly further comprising a pin coupled to the connector body and configured to extend through the slot of the safety sleeve, the slot and the pin together configured to constrain the sliding of the safety sleeve relative to the connector body.

Example 4 includes the safety adapter assembly of Example 3, in which the pin is configured to permanently join the safety sleeve to the connector body.

Example 5 includes the safety adapter assembly of any of Examples 1-4, in which the first electrical connector, the connector body, and the second electrical connector all together having an overall connector length; and in which the safety sleeve has an overall sleeve length, the overall sleeve length not being less than the overall connector length.

Example 6 includes the safety adapter assembly of any of Examples 1-5, the first electrical connector comprising a first connector type, and the second electrical connector comprising a second connector type that is not physically compatible with the first connector type.

Example 7 includes the safety adapter assembly of any of Examples 1-6, in which the first electrical connector comprises a first triaxial connector, and in which the second electrical connector comprises a second triaxial connector.

Example 8 includes the safety adapter assembly of any of Examples 1-7, in which the first electrical connector is configured to connect the safety adapter assembly to a test-and-measurement cable, and in which the second electrical connector is configured to connect the safety adapter assembly to a test-and-measurement device.

Example 9 includes the safety adapter assembly of any of Examples 1-8, in which the safety sleeve is substantially cylindrical.

Example 10 includes the safety adapter assembly of any of Examples 1-9, in which the safety sleeve is electrically nonconductive.

Example 11 includes the safety adapter assembly of any of Examples 1-10, in which the safety sleeve is further configured to abut an external device attached to the second electrical connector while substantially blocking user access to the first electrical connector.

Example 12 includes a method of using a safety adapter assembly for an electrical connector, the method comprising: moving a safety sleeve in a first direction relative to a connector body of the safety adapter assembly to expose a first electrical connector of the safety adapter assembly and to conceal a second electrical connector of the safety adapter assembly within the safety sleeve; attaching the first electrical connector to a first mating connector; sliding in a second direction the safety sleeve relative to the connector body of the safety adapter assembly to expose the second electrical connector of the safety adapter assembly and to conceal the first electrical connector of the safety adapter assembly within the safety sleeve; and attaching the second electrical connector to a second mating connector.

Example 13 includes the method of Example 12, in which the attaching the first electrical connector to the first mating connector comprises attaching the first electrical connector to a test-and-measurement cable.

Example 14 includes the method of any of Examples 12-13, in which the attaching the second electrical connector to the second mating connector comprises attaching the second electrical connector to a test-and-measurement device.

Example 15 includes the method of any of Examples 12-14, in which moving the safety sleeve in the first direction relative to the connector body of the safety adapter assembly comprises sliding the safety sleeve in the first direction.

Example 16 includes the method of Example 15, further comprising constraining the sliding of the safety sleeve in the first direction relative to the connector body of the safety adapter assembly by using a pin coupled to the connector body and configured to extend through a slot of the safety sleeve.

Example 17 includes the method of any of Examples 12-16, in which moving the safety sleeve in the second direction relative to the connector body of the safety adapter assembly comprises sliding the safety sleeve in the second direction.

Example 18 includes the method of Example 17, further comprising constraining the sliding of the safety sleeve in the second direction relative to the connector body of the safety adapter assembly by using a pin coupled to the connector body and configured to extend through a slot of the safety sleeve.

Example 19 includes the method of any of Examples 12-18, further comprising permanently joining the safety sleeve to the connector body using a pin.

Example 20 includes the method of any of Examples 12-19, further comprising, after attaching the second electrical connector to the second mating connector, constraining movement of the safety sleeve relative to the connector body to prevent user access to the first electrical connector.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Although specific embodiments have been illustrated and described for purposes of illustration, it will be understood that various modifications may be made without departing from the spirit and scope of the disclosure. Accordingly, the invention should not be limited except as by the appended claims.

What is claimed is:

1. A method of using a safety adapter assembly for an electrical connector, the method comprising:

moving a safety sleeve in a first direction relative to a connector body of the safety adapter assembly to expose a first electrical connector of the safety adapter assembly and to conceal a second electrical connector of the safety adapter assembly within the safety sleeve;

attaching the first electrical connector to a cable;

moving the safety sleeve in a second direction relative to the connector body of the safety adapter assembly to expose the second electrical connector of the safety adapter assembly and to conceal the first electrical connector of the safety adapter assembly within the safety sleeve; and attaching the second electrical connector to a second mating connector.

2. The method of claim 1, in which the attaching the second electrical connector to the second mating connector comprises attaching the second electrical connector to an external device.

3. The method of claim 1, in which moving the safety sleeve in the first direction relative to the connector body of the safety adapter assembly comprises sliding the safety sleeve in the first direction.

4. The method of claim 3, further comprising constraining the sliding of the safety sleeve in the first direction relative to the connector body of the safety adapter assembly by using a pin coupled to the connector body and configured to extend through a slot of the safety sleeve.

5. The method of claim 1, in which moving the safety sleeve in the second direction relative to the connector body of the safety adapter assembly comprises sliding the safety sleeve in the second direction.

6. The method of claim 5, further comprising constraining the sliding of the safety sleeve in the second direction relative to the connector body of the safety adapter assembly by using a pin coupled to the connector body and configured to extend through a slot of the safety sleeve.

7. The method of claim 1, further comprising permanently joining the safety sleeve to the connector body using a pin.

8. The method of claim 1, further comprising, after attaching the second electrical connector to the second mating connector, constraining movement of the safety sleeve relative to the connector body to prevent user access to the first electrical connector.

* * * * *